US005261551A

United States Patent [19]

Watt

[11] Patent Number: 5,261,551

[45] Date of Patent: Nov. 16, 1993

[54] PAINT OR SIMILAR CAN WITH OVERCAP HAVING A CENTRAL OPENING

[75] Inventor: Ramon C. Watt, Lockport, N.Y.

[73] Assignee: All-Pak, Inc., Pittsburgh, Pa.

[21] Appl. No.: 906,522

[22] Filed: Jun. 30, 1992

Related U.S. Application Data

[63] Continuation-in-part of Ser. No. 820,237, Jan. 14, 1992, Pat. No. 5,174,464.

[51] Int. Cl.[5] ..... B65D 51/18

[52] U.S. Cl. ..... 220/256; 220/319; 220/354; 220/358; 220/257

[58] Field of Search ..... 220/319, 315, 256, 257, 220/354, 358, 701

[56] References Cited

U.S. PATENT DOCUMENTS

| | | | |
|---|---|---|---|
| 983,883 | 2/1911 | Eckart . | |
| 1,128,076 | 2/1915 | Taliaferro | 220/358 X |
| 1,239,183 | 9/1917 | Hodgson . | |
| 1,847,245 | 3/1932 | Hothersall | 220/319 |
| 2,461,908 | 2/1949 | Magnesen | 220/319 |
| 3,133,669 | 5/1964 | Scholtz . | |
| 3,149,743 | 9/1964 | Scholtz . | |
| 3,158,282 | 11/1964 | Housz . | |
| 3,438,533 | 4/1969 | Hanisch et al. . | |
| 3,443,735 | 5/1969 | Meijers | 220/319 X |
| 3,696,963 | 10/1972 | Saunders | 220/315 X |
| 3,834,579 | 9/1974 | LaCroce . | |
| 4,111,330 | 9/1978 | Jordan | 220/319 X |
| 4,520,942 | 6/1985 | Dwinell | 220/257 |
| 4,607,759 | 8/1986 | Boetzkes | 220/266 |
| 4,728,003 | 3/1988 | Davey | 220/319 |
| 4,932,554 | 6/1990 | Smith et al. | 220/319 |

*Primary Examiner*—Allan N. Shoap
*Assistant Examiner*—Paul A. Schwarz
*Attorney, Agent, or Firm*—Buchanan Ingersoll; George Raynovich, Jr.

[57] ABSTRACT

A paint or similar can adapted to retain its lid in fluid tight condition against mechanical or pressure disturbances. The can has a ring element secured to the top of its sidewall and a lid assembled onto the ring element. Rubber or other sealant can be disposed between the ring element and lid to form one or more continuous seals between the ring element and lid. A metallic overcap having a debossment is placed over the lid. Stretchable adhesive tape is adherently applied to the overcap and the sidewall to hold the overcap down tightly against the lid with the debossment pressing against the lid to prevent the lid from backing off from the ring element and breaking the seal. The overcap has a circular central opening to uncover most of the top portion of said lid to allow the top portion of said lid to swell upwardly upon an increase of pressure within the can without dislodging the overcap. The debossment is at an intermediate position between the central opening and the outer periphery of the overcap.

19 Claims, 2 Drawing Sheets

PAINT OR SIMILAR CAN WITH OVERCAP HAVING A CENTRAL OPENING

This application is a continuation-in-part of Ser. No. 820,237, filed Jan. 14, 1992, now U.S. Pat. No. 5,174,464, issued Dec. 29, 1992, which is hereby incorporated by reference.

BACKGROUND OF THE INVENTION

This invention relates to a metal container for paint, paint thinner or other liquid and more particularly this invention relates to a can for liquid adapted to remain fluid tight under conditions tending to induce loss of a fluid tight seal at the lid of the can.

SUMMARY OF THE INVENTION

Many conditions can arise which tend to cause loss of a fluid tight seal at the lid of a can for paint, paint thinner or other liquid. For example, the can can be dropped, causing loss of the seal due to mechanical shock. The liquid in the can might produce vapors upon a temperature increase tending to create a pressure increase within the can. Also, the pressure outside of the can may be reduced, such as can occur in the hold of an airplane, tending to cause the lid to pop off or loosen or cause leakage of paint from the can. According to the present invention an overcap is placed over the lid of a paint can and the overcap is held down tightly against the lid by friction means or, preferably, by means of adhesive tape extending adherently across the overcap and down the sidewall of the can. The overcap is provided with a central opening. The central opening is preferably a circular opening which allows most of the lid of the paint can to remain uncovered. Thereby, the overcap serves as an annular or rim-like anchor for the lid while allowing the center of the lid to swell upwardly upon an increase of pressure within the can so that the lid assumes a convex configuration as viewed from the outside.

Paint cans commonly have a radially inwardly extending ring element secured to the top of the sidewall of the can and the lid is assembled onto this ring element. If desired, in accordance with this invention, sealant can be placed between the ring element and the lid to form one or a plurality of circular seals between the ring element and the lid. The sealant can be a rubberized compound or other material which is prebaked onto the lid on the one hand and onto the ring element on the other hand so that the sealant permanently adheres to the lid and ring element, respectively, as a manufacturing step prior to assembly of the paint can. The overcap of this invention is placed over the lid and is provided with a debossment which presses against the lid to maintain a liquid tight seal along a full circle between the lid and the ring element.

More particularly, the paint can of this invention comprises a cylindrical sidewall with an enclosed bottom and a ring element secured to the top of the sidewall. A ring groove extends in a circular path entirely around the ring element. The area at the top of the can not covered by the ring element defines a circular can opening and a circular lid is used to cover the opening. A lid groove extends in a circular path entirely around the lid and the lid groove and is inserted into the ring groove in friction tight relationship therewith when the lid is assembled onto the ring element. An overcap having a debossment and a central opening exposing most or a substantial portion of the area of the lid is placed over the assembled lid and ring element. The debossment is located in the cover portion of the overcap at an intermediate position between the central opening and the outer periphery of the overcap. The overcap has a peripheral skirt and when the overcap is in place adhesive tape is stuck fast across the top of the overcap and the exposed portion of the lid and tightly pulled down and stuck fast to the skirt of the overcap and the sidewall of the can to hold the overcap firmly down against the lid so that the debossment is in contact with and presses against the lid. As stated above, if required, some sealant is prebaked onto a surface of the ring element and additional sealant is prebaked onto a surface of the lid so that sealant is stuck tightly to these respective surfaces and forms continuous circular seals between the ring element and the lid.

Still more particularly, the ring element is secured to the top of the sidewall at a circumferential seam and extends radially inwardly from the sidewall. There is a downwardly extending ring groove extending in a circular path entirely around the ring element parallel to the top of the sidewall. The ring groove has a ring groove base and inner and outer ring groove rims. The area at the top of the can not covered by the ring element defines a circular can opening and a circular lid covers the can opening. The circumferential periphery of the lid rests on the ring element. The lid is provided with a downwardly extending lid groove extending in a full circular path parallel to the periphery of the lid and near the periphery of the lid. The lid groove has a lid groove base and inner and outer lid groove rims. The lid groove corresponds with, is inserted into and is in friction tight engagement with the ring groove and the lid is thereby assembled onto the ring element. An overcap having a downwardly depending peripheral skirt is disposed over the assembled lid and ring element with the skirt depending snugly along the upper region of the sidewall. A shallow debossment extends in a continuous circular path around the overcap at a position corresponding with the inner and outer rims of the lid groove. The debossment is shallow and depends only to the rim region of the lid groove. There is no need for the debossment to extend deeper into the lid groove than the rim region. The overcap has a central opening which allows most or all of the area of the lid whose underside is exposed to the contents of the can to remain uncovered to allow the lid to bulge or protrude in generally rounded elevation against or through said opening upon an increase of pressure within the can. The debossment is located in the cover portion of the overcap at an intermediate position between the central opening and the outer periphery of the cover portion. It can be substantially equidistant between the two or can be relatively closer to the outer periphery of the cover portion. Less preferably, it can be relatively closer to the central opening. Adhesive tape adherently extends across the overcap and down the sidewall to hold the overcap firmly against the lid so that the debossment abuts against the inner and outer rims of the lid groove. If desired, a rubber compound or other sealant can be adherently secured to the base of the ring groove and also to the underside of the inner rim of the lid groove so that two continuous liquid tight circular seals are created between the lid and the ring element.

When the lid is assembled onto the ring element, the lid is normally held securely onto the ring element by the frictional engagement between the abutting and complementary ring groove and lid groove surfaces. While there are multiple points of contact along these groove surfaces which provide a frictional engagement of the lid to the ring element, there will also be gaps between points of contact. These gaps may or may not be large enough to permit leakage of liquids therethrough, depending upon the viscosity of the liquid contained within the can. Perhaps a high viscosity liquid, such as paint, would not leak whereas a low viscosity liquid, such as paint thinner, would leak. Also, the downward force of the overcap of this invention may be great enough to close the leaks. However, where required, the use of a sealant between the lid and ring element completes the liquid seal between the lid and ring element.

In the absence of the overcap of this invention, the seal between the lid and ring element will usually be adequate to maintain the can in fluid tight condition absent any disturbing occurrence such as mechanical jarring or a pressure change inside or outside of the can, which could cause the lid to back off and thereby break the seal. A very slight lifting of the lid can break the seal and permit leakage. The purpose of the overcap is to prevent such a backing off when a disturbance occurs. In order to prevent the lid from backing off, the debossment in the overcap is located above the lid groove so that the debossment abuts against the lid groove to wedge it securely in place in the vicinity of the seal. Also, the central opening of the overcap tends to allow the lid to swell upon an increase in pressure within the can rather than forcing the lid to lift and break the seal. It is believed that when the lid bulges against the opening in the overcap it tends to flex upwardly the portion of the overcap between the opening and the debossment and force the debossment more firmly against the lid, thereby strengthening the seal. Thereby, the debossment is separated from the opening in the overcap, and is located at an intermediate position between the opening and the skirt edge of the overcap. In order to have adequate strength in the face of the bulging and flexing effects, the lid and overcap of this invention are metallic and are not plastic. Preferably, all elements in the can assembly are metallic.

In order to accommodate the lid bulging and overcap flexure effects, the tape which secures the overcap is a high strength, stretchable tape. Normal tapes have a 12 to 18 percent stretch before the adhesive will fail. This amount of stretch, or more, will be required in a tape for securing the overcap of this invention. The tape can comprise a polymer such as polypropylene having an adhesive backing. Tapes which are reinforced with filaments, such as glass yarn, provide stretch reduction. Therefore, the tape of this invention is a non-filament tape. The tape is preferably capable of adhering to the can over a temperature range of −40° to 140° F. and is water resistant. An example of a suitable adhesive tape is Scotchpar Tape No. 855, manufactured by 3M Packaging Systems Division.

BRIEF DESCRIPTION OF THE DRAWINGS

This invention will be more completely understood by reference to the accompanying drawings in which.

DESCRIPTION OF THE PREFERRED EMBODIMENTS

Figure 1:
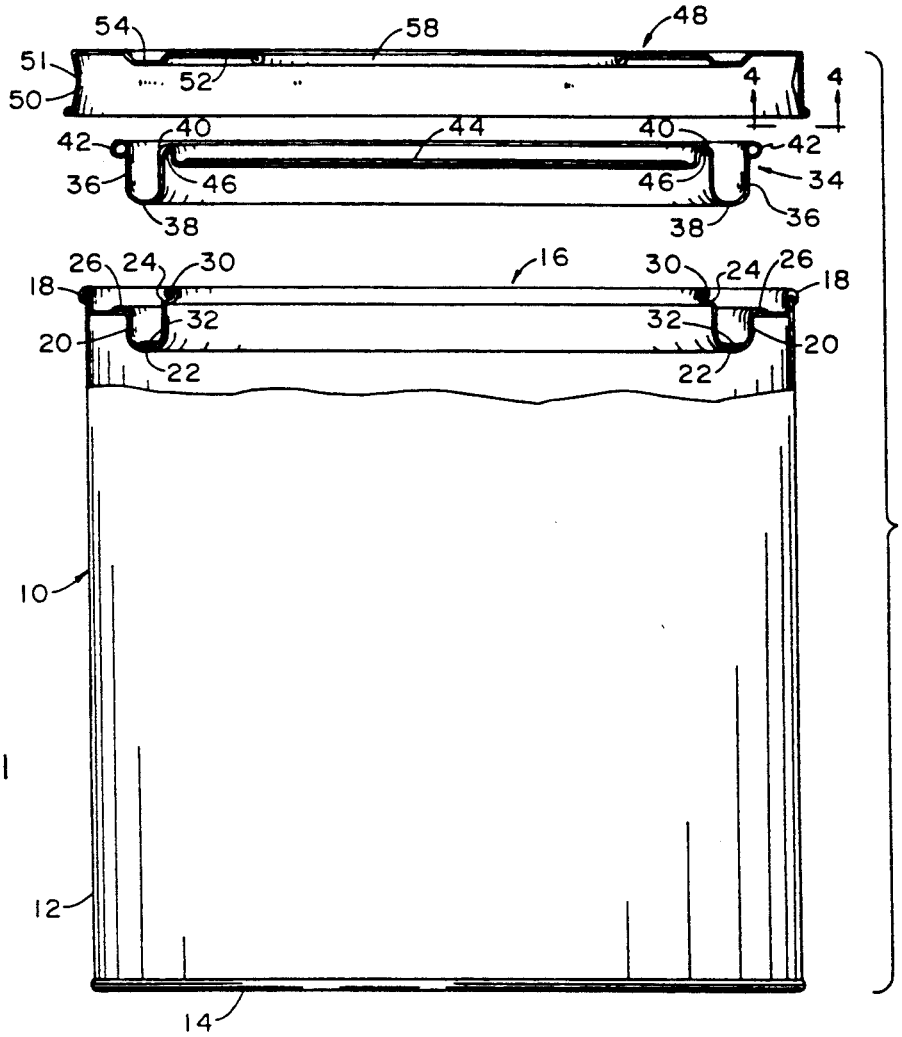
FIG. 1 is an exploded view of the can assembly showing the disassembled can, lid and overcap.

Referring to FIG. 1, paint can 10 includes cylindrical sidewall 12, bottom enclosure 14 and ring element 16. Ring element 16 is joined to sidewall 12 at fluid-tight folding seam 18. Ring element 16 includes circular ring groove 20 extending as a complete circle around ring element 16. Ring groove 20 has ring groove base 22 and inner and outer ring groove rims 24 and 26, respectively. Curved ring groove inner lip 30 extends upwardly and radially inwardly from inner groove rim 24. A rubber sealant material 32 is prebaked onto and adheres permanently to ring groove base 22.

FIG. 1 shows lid 34 which is provided with lid groove 36 extending as a complete circle around lid 34. Lid groove 36 includes lid groove base 38, lid groove inner rim 40 and lid groove outer rim 42. Lid 34 includes flat cover portion 44 which serves as a cover for the circular top opening of paint can 10. Rubber sealant material 46 is baked onto and adheres permanently to the underside of inner rim 40.

FIG. 1 also shows overcap 48 which includes skirt 50, cover portion 52 and debossment 54. Debossment 54 extends as a complete circle around cover portion 52 at a position corresponding to lid groove rims 40 and 42. Most or a substantial portion of cover portion 52 is cut away to provide a circular central opening 58 which allows most or a substantial portion of flat cover portion 44 of lid 34 to remain uncovered when the elements are assembled. For example, the entire top of the overcap is cut away over 30, 40, 50, 60 percent, or more, of its diameter. Debossment 54 is separated from opening 58 by a distance provided by cover portion 52. If lid 34 bulges upwardly due to a build-up of pressure within the can, cover portion 52 can flex upwardly and act as a lever to press debossment 54 downwardly to increase the fluid seal in the can.

Figure 2:
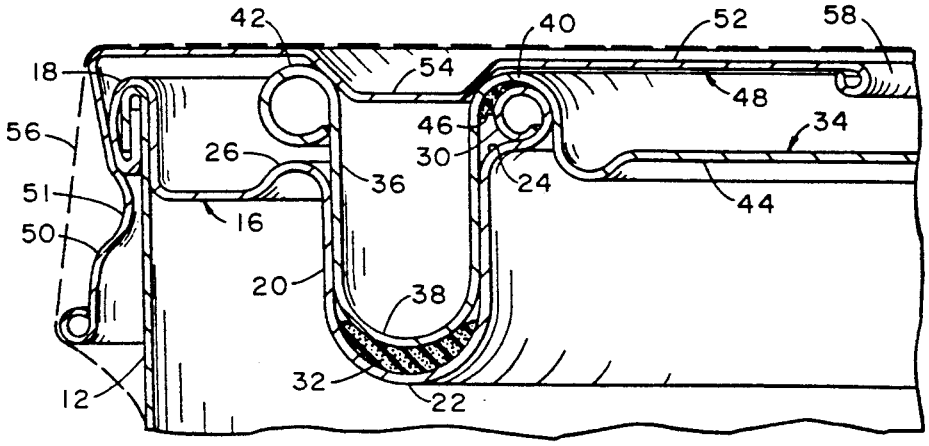
FIG. 2 is a cross-section of a fragment of the assembled can, lid and overcap.

FIG. 2 illustrates the assembled arrangement of ring element 16, lid 34 and overcap 48. As shown in FIG. 2, lid groove 36 fits snugly into ring groove 20 so that rubber element 32 is compressed between base 22 of ring groove 20 and base 38 of lid groove 36 to establish a first continuous liquid tight circular seal. At the same time, separate rubber element 46 is compressed between lip 30 of ring element 16 and inner lip 40 of lid 34 to establish a second continuous fluid tight circular seal.

FIG. 2 shows that the two rubber fluid tight seals are firmly compressed and lid 34 is held securely in place by means of overcap 48 whose debossment 54 in cover portion 52 abuts against inner and outer rims 40 and 42 of lid 34 as skirt 50 of overcap 48 holds overcap 48 in place while abutting springingly against seam 18 by means of crimp 51. Debossment 54 only needs to be deep enough to abut against one or both rims 40 and 42 of lid 34. Debossment 54 does not need to extend into lid groove 36 more deeply than the region of rims 40 and 42. Commonly, debossment 54 can be about one-sixteenth inch deep. Overcap 48 is more positively secured by means of a plurality of strips 56 of stretchable adhesive tape which can adherently criss-cross some or all of cover portion 52 of overcap 48 and adherently extend down skirt 50 and partially down sidewall 12 of the can, as shown in FIG. 3.

Figure 3:
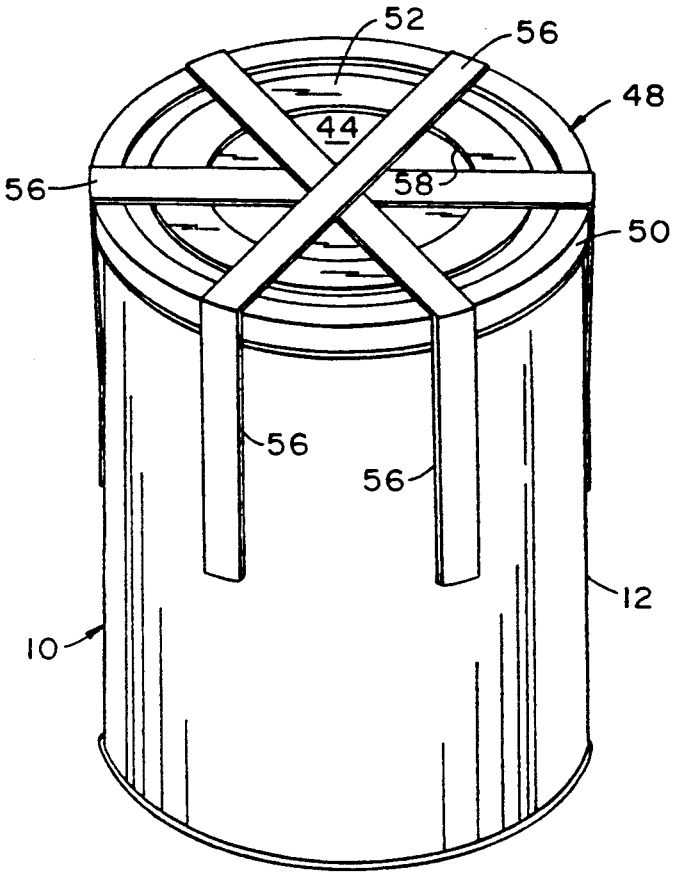
FIG. 3 is an isometric outside view of the completed can assembly.

FIGS. 2 and 3 show that most or a substantial portion of cover portion 44 of lid 34 remains uncovered in the assembled can due to circular central opening 58 in overcap 48. This makes it easier for cover 44 to swell upwardly upon an increase in pressure within can 10 whereby overcap 48 can more effectively prevent dislodgement of lid 34 from ring element 16.

Figure 4:
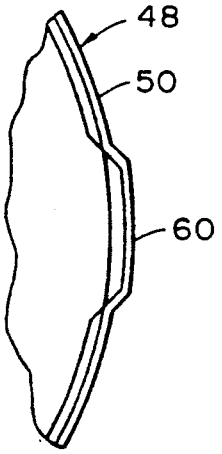
FIG. 4 is a cross-section of a fragment of an offset handle on the overcap.

FIG. 4 shows that skirt 50 of overcap 48 can be provided with an offset handle 60 to facilitate release of overcap 48 from can 10 by insertion of a tool such as a screwdriver underneath offset handle 60 for prying off overcap 48 to remove lid 34 and open can 10. Crimp 51 in skirt 50 can be designed to provide a friction tightness for securing the overcap to the can which is sufficiently great that tape is not required. In that case, offset handle 60 would be required to release the overcap. However, the force of a screwdriver at offset handle 60 could damage can 10. Therefore, because of its non-destructive removal, the use of a tape is preferred over friction tightness for securing the overcap to the can.

EXAMPLE

Tests were performed wherein a paint can was modified to perform a hydrostatic pressure test to achieve a differential pressure of 95 kpa (14.7 psi) through a tap installed on the side of the can and leading into the interior of the can. The pressure within the can was increased by applying pressured air to a water-filled can to create a pressure in the can sufficiently high to cause swelling to occur at the lid. One series of tests was performed wherein a metallic overcap of this invention having a debossment and a central opening was used. Another series of tests used similar conditions except that a similar metallic overcap without a central opening was used. In all the tests the swelling at the lid caused the lid to expand into contact with the overcap. In the tests in which the overcap did not have a central opening, there was about a 20 percent failure rate, i.e. the lid leaked. In contrast, in fifteen similar tests wherein the overcap was metallic and had a central opening, there were no instances of lid leakage. In tests wherein the overcap had a central opening but was made of plastic, there was about a 25 percent failure rate.

Apparently, when an overcap having no central opening is used, swelling of the lid under internal pressure can lift the debossment in the overcap away from the lid. However, when a central opening is provided in the overcap, the swollen portion of the lid bulges against the opening and, instead of lifting the overcap, it flexes the overcap in a manner which causes the debossment to press more firmly against the lid. In this manner, the swelling at the lid can actually enhance the holding power of the overcap on the lid.

I claim:

1. A can for holding liquid comprising a cylindrical sidewall with an enclosed bottom, a radially inwardly extending ring element secured to the top of said sidewall, a ring groove extending in a circular path around said ring element, the area at the top of said can not covered by said ring element defining a circular can opening, a circular lid covering said can opening, a lid groove extending in a circular path around said lid, said lid groove inserted into said ring groove in friction tight engagement therewith, a metallic overcap, said overcap comprising a cover portion and a peripheral skirt, said overcap disposed over the assembled ring element and lid, said overcap cover portion extending radially inwardly from said peripheral skirt to completely cover said lid groove, a debossment in said cover portion of said overcap, a central opening in said overcap, said central opening leaving a major portion of the top of said lid uncovered, said debossment located at an intermediate position in said cover portion relative to said central opening and the periphery of said overcap, and means to hold said overcap firmly down against said lid so that said debossment is in contact with the top of said lid radially inwardly and radially outwardly of said lid groove.

2. The can of claim 1 wherein said debossment is about equidistant between said central opening and the periphery of said overcap.

3. The can of claim 1 wherein said debossment is relatively closer to the periphery of said overcap than to said central opening.

4. The can of claim 1 including sealant located between said ring element and lid to form a continuous circular seal between said ring element and lid.

5. The can of claim 4 wherein the sealant is adherently secured within said ring groove.

6. The can of claim 1 wherein said means to hold is adhesive tap and salt tape is capable of adhering to the can at a temperature range of −40° to 140° F. and is water resistant.

7. The can of claim 4 wherein the sealant is adherently secured on the underside of said lid.

8. The can of claim 4 wherein the sealant is adherently secured within said ring groove and on the underside of said lid to form continuous circular seals between said ring element and lid.

9. The can of claim 1 wherein said means to hold said overcap is a crimp on said skirt so that said skirt depends with friction tightness around an upper region of said sidewall.

10. The can of claim 1 wherein said debossment extends in a continuous circular path around said cover portion of said overcap.

11. The can of claim 1 wherein said debossment abuts against the upper region of said lid groove without extending deeply into said lid groove.

12. The can of claim 1 wherein said central opening is a circular opening.

13. The can of claim 1 wherein said means to hold said overcap comprises adhesive tape extending across said overcap and down said sidewall.

14. A can for holding liquid comprising a cylindrical sidewall with an enclosed bottom, a ring element secured tot he top of said sidewall and extending radially inwardly from said sidewall, a downwardly extending ring groove extending in a circular path along said ring element concentric with the top of said sidewall, said ring groove having a ring groove base and inner and outer ring groove rims, the area at the top of said can not covered by said ring element defining a circular can opening, a circular led covering said can opening, the circumferential periphery of said lid resting on said ring element, a downwardly extending lid groove extending in a circular path around said lid, said lid groove having a lid groove base and inner and outer lid groove rims, said lid groove corresponding with and inserted into said ring groove in friction tight relationship therewith when said lid is assembled onto said ring element, a metallic overcap having a cover portion and a downwardly depending peripheral skirt, said overcap disposed over the assembled ring element and lid with said skirt depending snugly along the upper region of said sidewall, said overcap cover portion extending radially inwardly from said peripheral skirt to completely cover said lid groove, a generally circular central opening in said overcap uncovering a major portion of the top of said lid, a debossment extending in a circular path around said cover portion of said overcap at a position corresponding with the inner and outer rims of said lid groove, said debossment located at an intermediate position in said overcap between said central opening and the outer periphery of said overcap, said debossment depending only tot he rim region of said lid groove, stretchable polymer tape with a backing of adhesive film extending across said cover portion of said overcap and down said skirt and sidewall to hold said overcap firmly down against said lid so that said debossment is in contact with the top of said lid radially inwardly and radially outwardly of said lid groove.

15. The can of claim 14 including a sealant located at the base of said ring groove and one the underside of the inner rim of said lid groove so that continuous circular seals are created between said lid and said ring element.

16. The can of claim 14 wherein said debossment is relatively closer to said central opening than the outer periphery of said overcap.

17. The can of claim 14 wherein said debossment is relatively closer to the outer periphery than to said central opening.

18. The can of claim 14 wherein said debossment is relatively equidistant between said central opening and the outer periphery of said overcap.

19. The can of claim 14 including an offset segment on the skirt of said overcap for removing said overcap.

* * * * *

UNITED STATES PATENT AND TRADEMARK OFFICE

CERTIFICATE OF CORRECTION

PATENT NO. : 5,261,551

DATED : November 16, 1993

INVENTOR(S) : RAMON C. WATT

It is certified that error appears in the above-indentified patent and that said Letters Patent is hereby corrected as shown below:

Column 6, line 22, change "tap" to --tape-- and change "salt" to --said--.

Column 6, line 55, change "led" to --lid--.

Column 7, line 9, change "tot he" to --to the--.

Signed and Sealed this

Twelfth Day of July, 1994

*Attest:*

*Attesting Officer*

BRUCE LEHMAN

*Commissioner of Patents and Trademarks*